US005279221A

United States Patent [19]

Miller et al.

[11] Patent Number: 5,279,221

[45] Date of Patent: Jan. 18, 1994

[54] SCREEN PRINTING APPARATUS AND METHOD

[75] Inventors: Michael J. Miller, Evans City; Larry J. Miller, Harmony; Henry L. Miller, Pittsburgh, all of Pa.

[73] Assignee: Miller Screen and Design, Inc., Mars, Pa.

[21] Appl. No.: 34,137

[22] Filed: Mar. 22, 1993

Related U.S. Application Data

[63] Continuation-in-part of Ser. No. 583,158, Sep. 17, 1990, abandoned.

[51] Int. Cl.[5] ..... B41L 13/02

[52] U.S. Cl. ..... 101/127.1; 101/129; 101/128.1

[58] Field of Search ..... 101/127, 127.1, 128, 101/128.1, 128.21, 128.4, 129

[56] References Cited

U.S. PATENT DOCUMENTS

| | | | |
|---|---|---|---|
| 2,191,134 | 2/1940 | Playford et al. | 101/127.1 |
| 2,299,628 | 10/1942 | Johnson et al. | 101/127.1 |
| 3,894,487 | 7/1975 | Miller | 101/127 |
| 4,137,842 | 2/1979 | Miller | 101/128.3 |
| 4,373,441 | 2/1983 | Messerschmitt | 101/127.1 |
| 4,520,727 | 6/1985 | Miller | 101/127 |
| 4,903,592 | 2/1990 | Ericsson | 101/115 |
| 4,905,592 | 3/1990 | Sorel | 101/127.1 |

FOREIGN PATENT DOCUMENTS

| | | | |
|---|---|---|---|
| 0933412 | 9/1973 | Canada | 101/127 |
| 0114953 | 7/1983 | Japan | 101/128.1 |

*Primary Examiner*—Edgar S. Burr
*Assistant Examiner*—Lynn D. Hendrickson
*Attorney, Agent, or Firm*—Clifford A. Poff

[57] ABSTRACT

A composite stencil screen assembly including a uniformly-prestressed resilient backing screen attached to a frame and a metallic wire mesh stencil screen attached to the backing screen. A predetermined portion of the backing screen is removed after the stencil screen is attached thereto in order to permit the pre-stressing force in the backing screen to uniformly pre-stress the stencil screen in all directions to impart a tight, wrinkle-free, high-quality printing surface to the stencil screen. In a preferred embodiment, the assembly is retensioned subsequent to removal of the predetermined portion of the backing screen. The composite construction is uncomplicated in design, resists metal fatigue of the wire mesh stencil screen, is effectively used in non-thermally dependent and thermally dependent printing operations, and has a long service life.

5 Claims, 8 Drawing Sheets

SCREEN PRINTING APPARATUS AND METHOD

CROSS REFERENCE TO RELATED APPLICATION

This application is a continuation-in-part of U.S. patent application Ser. No. 07/583,158, filed Sep. 17, 1990 now abandoned.

BACKGROUND OF THE INVENTION

1. Field of the Invention

The present invention generally relates to printing apparatus, and, more particularly, to an improved screen printing apparatus, its method of manufacture, and its method of use.

2. Description of the Prior Art

Stencil screens are extensively employed to apply coatings to surfaces of mass-produced articles of manufacture. The coatings may be applied so as to produce simple schemes or patterns or they may be applied in more elaborate decorative designs including manufacturer's names, product names, logos, and similar types of information. During printing, a printing or coating medium such as ink or a thermally responsive material is forced by means of a squeegee through exposed areas of the screen which delineate the intended design to be transferred onto the surface of the article.

Examples of prior art stencil screen printing apparatus are shown in U.S. Pat. No. 3,894,487, U.S. Pat. No. 4,137,842 and U.S. Pat. No. 4,520,727. Each of these patents disclose apparatus having a metallic wire mesh design-bearing stencil screen which is secured to a metallic frame. In operation of these apparatus, the stencil screen is pushed slightly outwardly and drawn taut by the squeegee during each design transfer application. Upon completion of the transfer application, the squeegee is retracted and the screen is permitted to relax to its original condition. During their useful service lives, such screens are adaptable to screen printing a wide variety of surfaces and/or articles of manufacture. Unfortunately, particularly in printing flat substrates, the continuous tensioning and relaxing of the wire mesh screen material soon causes unavoidable and harmful fatigue of the material (particularly where the material is in contact with the lower edges of the metallic frame), hence leading to premature failure of the screen.

A further disadvantage of stencil screen apparatus of this type is that the wire mesh screen cannot always be tensioned uniformly over the entire area of the frame to which it is secured. For example, the screen is usually tensioned and cemented along substantial portions thereof to a rubber boot which surrounds the frame while the remaining portions of the screen are held in metal compression clamps which act as bus bars at times when the screen is heated by electrical resistance, such clamps usually being adjustably secured by screws to opposite ends of the frame. Due to its inherent non-suppleness, metallic wire mesh screen is difficult to attach to the rubber boot under sufficient tension to cause the screen to tightly conform to the shape of the frame. Consequently, the wire mesh screen can only be effectively tensioned along its length dimension where its clamped ends are adjustably connected to the frame by the aforementioned screws. Such non-uniform tensioning of the screen has been known to produce wrinkles and/or other variably-tensioned areas in the screen which deleteriously affect the quality of the image which is transferred by the screen to the article.

Such screens further have relatively limited inherent resiliency. This generally does not create a problem during many printing operations. However, at times when thermally responsive printing medium is applied by the screen printing apparatus, i.e., at times when the screen and printing medium are heated, the thermally responsive printing medium, if applied to a substantially cooler surface such as glass, for example, quickly sets upon contact therewith and causes the screen to adhere to the surface of the article. A practical example of where this situation physically occurs is in manufacturing plants wherein ultraviolet or colored strips of coating are applied to windshield glass, and the like. Under such conditions, retraction of the screen from the article surface usually causes removal of at least a portion of the printed image from the article surface thus essentially destroying the printed image.

In such thermally dependent printing operations, it would be most advantageous if the screen structure could be provided with greater inherent resiliency whereby it would positively and virtually instantaneously return to its initial position upon passage of the squeegee to thereby prevent sticking or blocking of the screen to the cooler article surface.

U.S. Pat. No. 4,373,441 and German Offenlegungsschrift No. 29 16 391 disclose composite stencil screen apparatus which require elaborate constructions involving electroplating opposite end portions of a metallic stencil screen that are thermoplastically secured to a thermoplastic synthetic resin material such that the thermoplastic securement between the wire stencil screen the resin material is not damaged during electrical resistance heating of the stencil screen.

An advantage exists, therefore, for a stencil screen printing screen construction which is: 1) resistant to metal fatigue, 2) uniformly tensioned across its length and width dimensions, and 3) high in inherent resiliency.

It is accordingly an object of the present invention to provide a stencil screen printing apparatus having a printing screen construction which is resistant to metal fatigue and, therefore, of long service life.

It is a further object of the present invention to provide a stencil screen printing apparatus having a printing screen construction which is uniformly tensioned in all directions within the plane of the stencil screen to thereby provide a high-quality image transfer surface.

It is a further object of the present invention to provide a stencil screen printing apparatus having a printing screen construction which is high in inherent resiliency and, therefore, especially useful in thermally dependent printing applications wherein a substantial temperature differential exists between the screen and the article surface being coated; such a highly resilient printing screen construction thereby preventing adhering of the screen to the article surface which is caused by the rapid cooling and setting of the thermally responsive printing medium upon contract with the cooler article surface.

It is another object of the present invention to provide a stencil screen printing apparatus having a printing screen construction which permits accurately controllable and essentially uniform electrical resistance heating of the screen in the instances where the printing medium is thermally responsive.

It is yet a further object of the present invention to provide methods of manufacture of a stencil screen printing apparatus which will produce an apparatus capable of fully attaining all of the aforenoted objects.

It is still a further object of the present invention to provide a method of coating article surfaces with at least one color of thermally responsive printing medium at speeds heretofore unattainable by the printing screen apparatus of the prior art through the use of at least one stencil screen printing apparatus having the novel structural features of the present invention in order to achieve rapid and effective printing of articles, such method finding particular advantage in high-volume production environments.

Still other objects and advantages will become apparent in light of the attached drawings and the written description of the invention presented herebelow.

SUMMARY OF THE INVENTION

The present invention relates to a method for printing indicia on a substrate, said method comprising the steps of (a) selecting a substrate defining a substantially planar surface for the reception of printed indicia thereon (b) selecting a stencil screen apparatus including a frame having walls defining an opening in said frame, a stencil screen, and resilient material attached to said frame and said stencil screen for resiliently supporting and substantially uniformly tensioning said stencil screen in all directions within the plane of said stencil screen, said resilient material having a first surface to which said stencil screen is adhesively attached and a second surface facing opposite said first surface, said second surface facing said substrate during printing thereof by said assembly, (c) elastically stressing said resilient material to create a resilient screen restoring force by using a printing applicator to move a portion of said stencil screen which is in contact with a printing applicator in a direction to bring the displaced part of the screen into contact with said planar surface of the substrate, said stencil screen being moved in a direction against said resilient material to minimize stressing of the adhesive attachment therebetween, (d) urging a printing medium to pass through exposed spaces in the stencil screen by the passage of said applicator along a plane generally parallel with said plane of the stencil screen for transferring the printing medium onto said substrate, and (e) using the said restoring force of the elastically stressed resilient material to positively and instantaneously retract said stencil screen from said indicia receiving surface of the substrate upon passage of said applicator.

In the preferred embodiment of the present invention, thermal plastic paint is melted by electrically heating the screen and offers the improved printing operation by allowing the volume of liquid paint passed through the open spaces in the screen to immediately freeze to the substrate upon separation of those open spaces from the planar substrate. The immediate freezing of the printing medium greatly enhances the use of the present invention for multi-color printing since sequential color printing can be carried out without incurring a delay between each of the printing operations. This is greatly advantageous in color-on-color printing where, for example, a first printing of a color forms a base to receive in a superimposed relation additional color by subsequent printing operations.

DESCRIPTION OF THE PREFERRED EMBODIMENT

Figure 1:
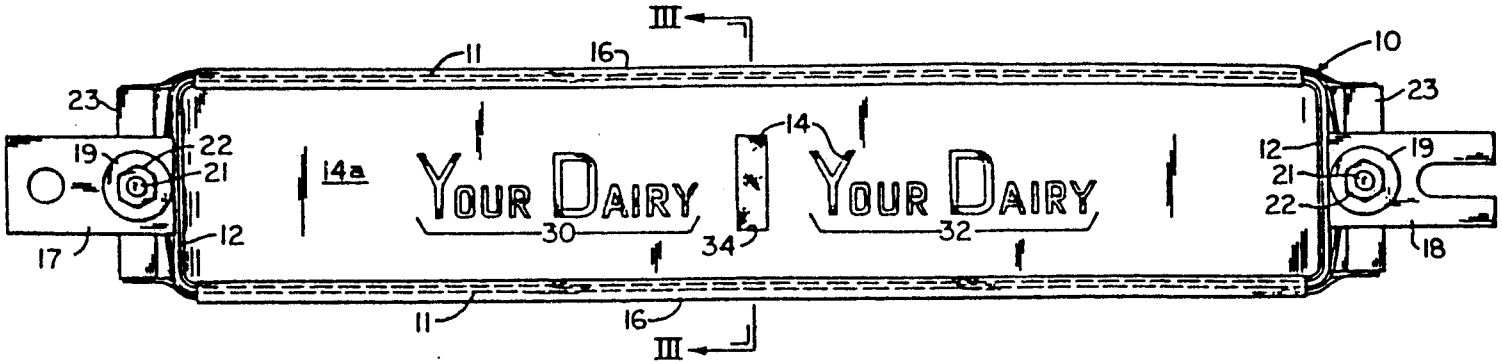
FIG. 1 is a plan view of a prior art stencil screen apparatus.
Figure 2:
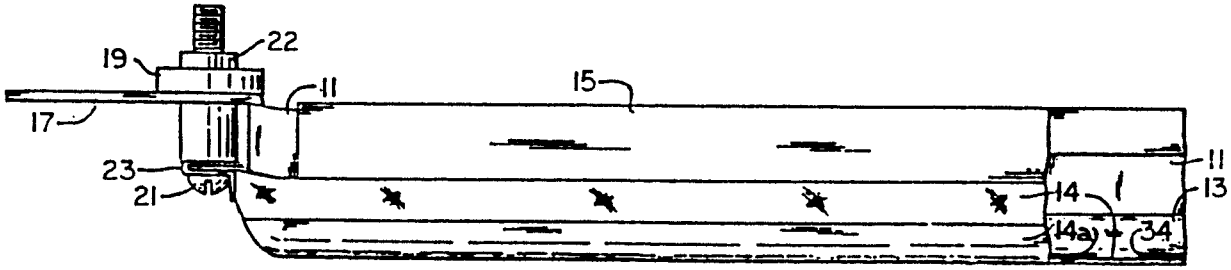
FIG. 2 is an enlarged partial side view of the stencil screen apparatus shown in FIG. 1.
Figure 3:
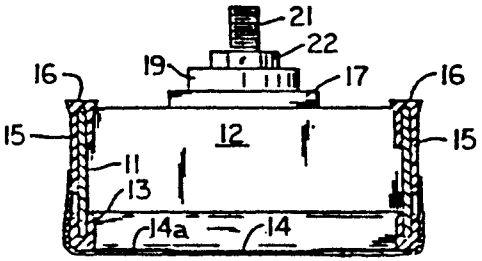
FIG. 3 is a sectional view as seen along line III—III of FIG. 1.

With reference now to FIGS. 1 and 2, there is illustrated a typical prior art stencil screen assembly which includes a rectangularly-shaped metal frame 10 having opposed side walls 11 and 12. As best shown in FIG. 3, a molded rubber gasket 13 forms a contiguous member at the bottom of the walls 11 and 12 for supporting a stencil screen 14. The screen 14 is preferably a fine wire mesh of stainless steel. The longitudinal sides of the screen are attached to an extended leg 15 of a U-shaped clamp which is designed to fit tightly upon the upper edge of the side walls 11. Brackets 17 and 18 are attached to and extended from the end walls 12. Each of these brackets has an opening into which there is received a rubber grommet 19. Passing through the grommet is a screw 21 having a nut 22 threaded on its upper end. The screws 21 are employed to hold metal compression clamps 23 at each side of the frame to the brackets 17 and 18, respectively, while electrically isolated therefrom. The metal compression clamp 23 is used as a transition member for clamping an end of the screen so that it can be, in turn, held under sufficient tension to the frame via the screw 21 and nut 22.

The screen 14 is processed using suitable well-known techniques for defining a desired design of an image to be printed. This is accomplished by impregnating the screen with an emulsion or other non-porous substance to leave a residual film 14A within the screen and to a limited extent at opposite sides of the screen. It will be understood that absence of the film 14A will expose the paint and the screen for the passage of a printing medium such as ink, paint, and the like. In FIG. 1, for the purpose of illustration only, there are exposed areas of the screen forming the words "Your Dairy" within an area 30 of the screen. Following this is a blank area 34 wherein the screen is again exposed by an absence of the film 14A. Following the blank area, there is a second area at 32 for the printing in the second instance of the words "Your Dairy".

The method of printing using such apparatus may be readily carried out by procuring a supply of screens bearing outlines of desired designs for printing. In the apparatus depicted in FIG. 1, a typical design is generally represented by the words "Your Diary" twice repeated. It will be understood, however, that the designs for printing can vary widely in detail and complexity. When printing is to be undertaken, a selected stencil screen is attached to a printing machine (not shown) whereby the stencil screen restricts and confines the flow of printing medium through the open areas 30, 32 and 34. In the event the printing is to be carried out through the use of a thermosetting ink, lead wires from a suitable power supply are attached to the screws 21 by means of additional nuts to jam against the nuts 22. In this manner, direct resistance heating of the screen 14 occurs. Ink is then deposited within the area defined by the frame and distributed across the face of the screen by the use of squeegee or other well-known printing medium applicator means, which, by its passage, moves the stencil screen into contact with the surface of an article to be printed. It will be understood, however, that the thermoplastic ink may and screen 14 may be heated by radiant heaters submerged therein within the confines of the frame 10.

The stencil screen apparatus thus far discussed is similar in most aspects to the stencil screen assemblies disclosed in U.S. Pat. No. 3,894,487, U.S. Pat. No. 4,137,842 and U.S. Pat No. 4,520,727 and, as such, it is susceptible to the same structural disadvantages normally associated with those stencil screen constructions. That is to say, the screen of the stencil screen apparatus of FIGS. 1, 2 an 3 is subject to metal fatigue, it is difficult to uniformly tension across both its length and width dimensions, and it is low in inherent resiliency. Furthermore, such a stencil screen construction, if subject to electrical resistance heating, does not permit accurately controllable and essentially uniform electrical resistance heating of the screen due to the unavoidably large size of the metal screen itself.

Turning to FIGS. 4–8, wherein like references indicate similar elements, there is seen a sequential depiction of the preferred method for constructing the first and most preferred embodiment of the stencil screen apparatus of the present invention. Similar to the prior art stencil screen apparatus shown in FIGS. 1–3, the instant stencil screen apparatus depicted in perspective in FIG. 4 includes an open frame 110 having opposed side walls 111 and opposed end walls 112. Secured to an edge of the side walls and end walls is an outwardly projecting flange 113 having a plurality of holes 113A formed herein.

Figure 5:
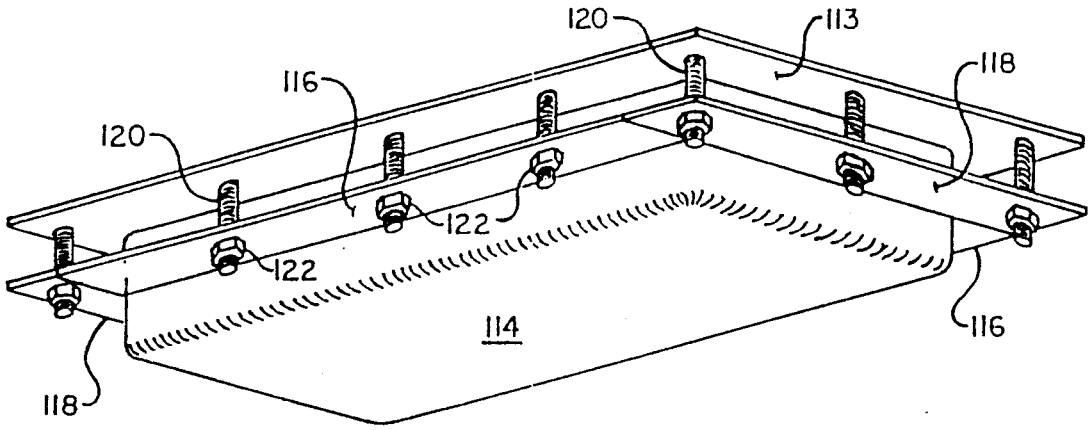

The perspective view of FIG. 5 shows that a support screen 114 formed of a layer of non-electrically-conductive material preferably having relatively high suppleness and resilience, such as polyester mesh or the like, is stretched along its longitudinal sides and its ends and is attached, as by variable tensioning means, for example, to the outer sides of side walls 111 and end walls 112.

Figure 6:
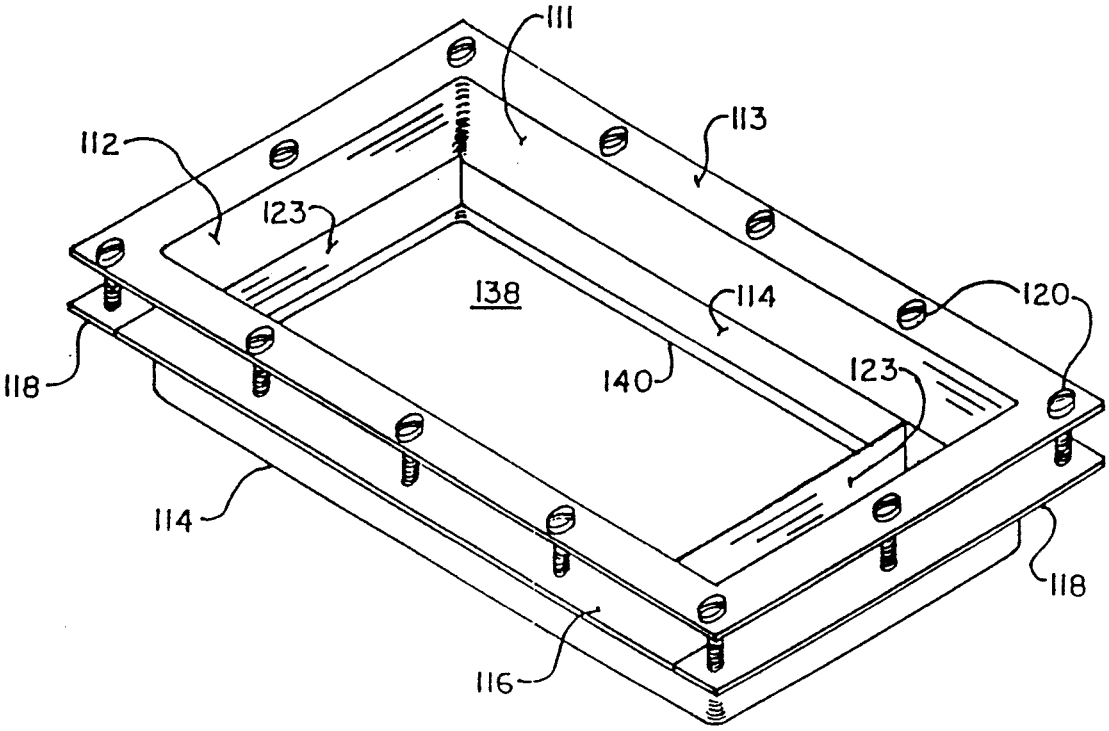

The exemplified variable tensioning means for tensioning or stretching of the support screen, which are perhaps best seen in FIGS. 5 and 6, are merely representative of one suitable construction which may be used for tensioning the support screen in accordance with the preferred embodiment of the present invention and are described herebelow as follows;

Secured to opposite side edges of the support screen 114 are a first pair of the bars 116 and secured to opposite end edges of the support screen are a second pair of bars 118. Bars 116 and 118 have a plurality of holes formed therethrough which cooperate and align with holes 113A and flange 113 to receive a plurality of threaded fasteners or screws 120 each of which are threadedly engaged by a nut 122. Each of the threaded fasteners or the nuts can be individually tightened to any desired degree. However, it is preferred that they be tightened such that the tension or support screen 114 be uniform in both its longitudinal and lateral dimensions. As noted supra, it is contemplated that other suitable variable tensioning means may be used for tensioning the support screen. For example, the threaded fasteners may be replaced by hand-cranked knobs, and the like. Moreover, as will be appreciated, the number and size of adjustable fasteners situated along the side and end edges of the screen assembly will depend on the size of the apparatus and the desired degree to which the support screen is to be stretched.

During attachment to the side walls 111 and end walls 112 of frame 110, the side edges and end edges of screen 114, are held in tension at a uniform magnitude of tensile force whereby the support screen is uniformly prestressed in both its longitudinal and lateral dimensions so as to be assuredly taut, wrinkle free, and in tight conformation with the shape for the frame 110. Upon attachment to frame 110 the screen 114 is thus imparted with a high degree of resilience in its unsupported central region, i.e., the region located interiorly of the boundary formed by side walls 111 and end walls 112, which for purposes of illustration, may reasonably be considered somewhat analogous to that of a musical drum skin. A supple and resilient, yet durable, material is particularly preferred as the material which forms support screen 114 since such material, by its very nature, is highly resistant to fatigue. Specific advantages produced by the inclusion of the prestressed resilient support screen in the stencil screen assembly of the present invention will be discussed in greater detail hereinbelow.

Figure 4:
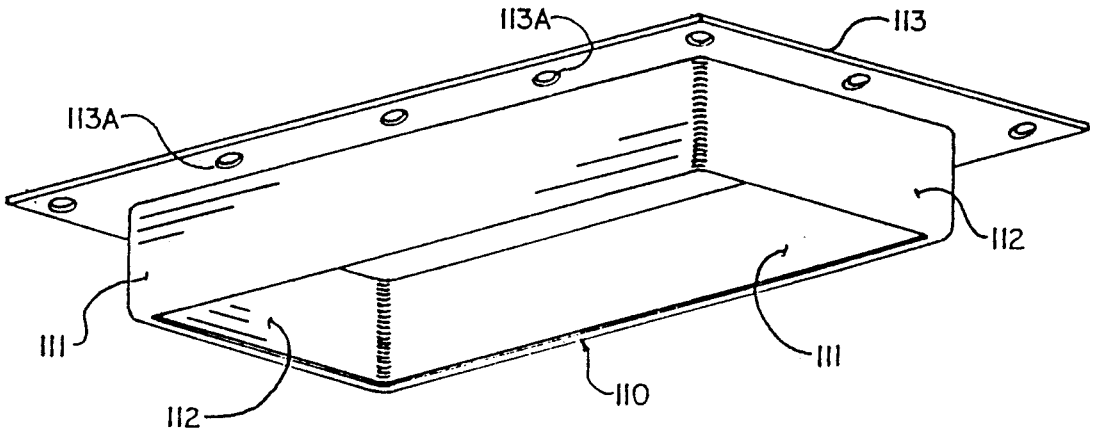
FIG. 4 through FIG. 8 are views of a first embodiment of the stencil screen apparatus of the present invention illustrating the preferred sequence of construction thereof.
Figure 7:
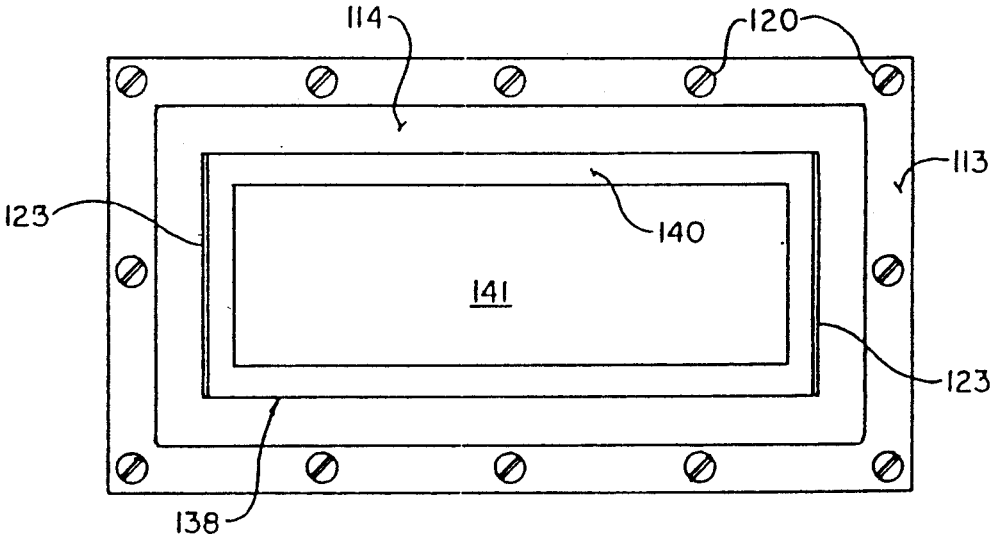

FIGS. 6 and 7 represent inverted views, in perspective and plan, respectively, of the stencil screen apparatus shown in FIGS. 4 and 5 in a later stage of construction, thereof. As FIGS. 6 and 7 illustrate, a stencil screen 138 is affixed to the backing screen subsequent to its attachment to frame 110. According to the present invention, the stencil screen 138 comprises a metallic, preferably stainless steel and previously de-greased wire mesh stencil screen of less width than the support screen 114. The stencil screen is laid flat and held in position, for example, by double-sided adhesive tape on the side of the prestressed support screen 114 which is contacted by the printing material spreader during printing. The wire mesh stencil screen 138 is then permanently attached along peripheral portions thereof to the support screen, as by adhesives or heat bonding, for example, such that there is created an overlapped area of bonding between the stencil screen and the support screen, such overlapped bonding area being herein designated by the numeral 140. Hence, in accordance with the present invention, a central portion 141 of the stencil screen 138 is not bonded or otherwise attached to the support screen 114. The bond between stencil screen 138 and support screen 114 brought about by bonding area 140 must be sufficient to withstand shear forces exerted thereon during subsequent removal of a central portion of the support screen 114 and, if required, subsequent retensioning of the support screen, both which steps are described hereinbelow.

When thermally responsive printing medium is used, metallic clamps 123, like clamps 23 of FIGS. 1–3, are attached to opposite ends of the metallic stencil screen 138 and act as bus bars for producing resistance heating of stencil screen 138 when sources of electrical potential are attached thereto. It will be understood that the length of the clamps 123 are preferably at least as great as the width of the indicia to be ultimately formed on stencil screen 138, however, the length may extend the full width of the stencil screen, as in the illustrated embodiment, if desired.

A general advantage attendant to this and later described constructions of the present invention is that due to the electrical insulating capacity of the non-conductive support screen, which is interposed between the stencil screen and the frame, the need for elements such as the molder rubber gaskets 13 and 15 (FIGS. 1-3) at the bottom and top edges of the screen is eliminated.

Figure 8:
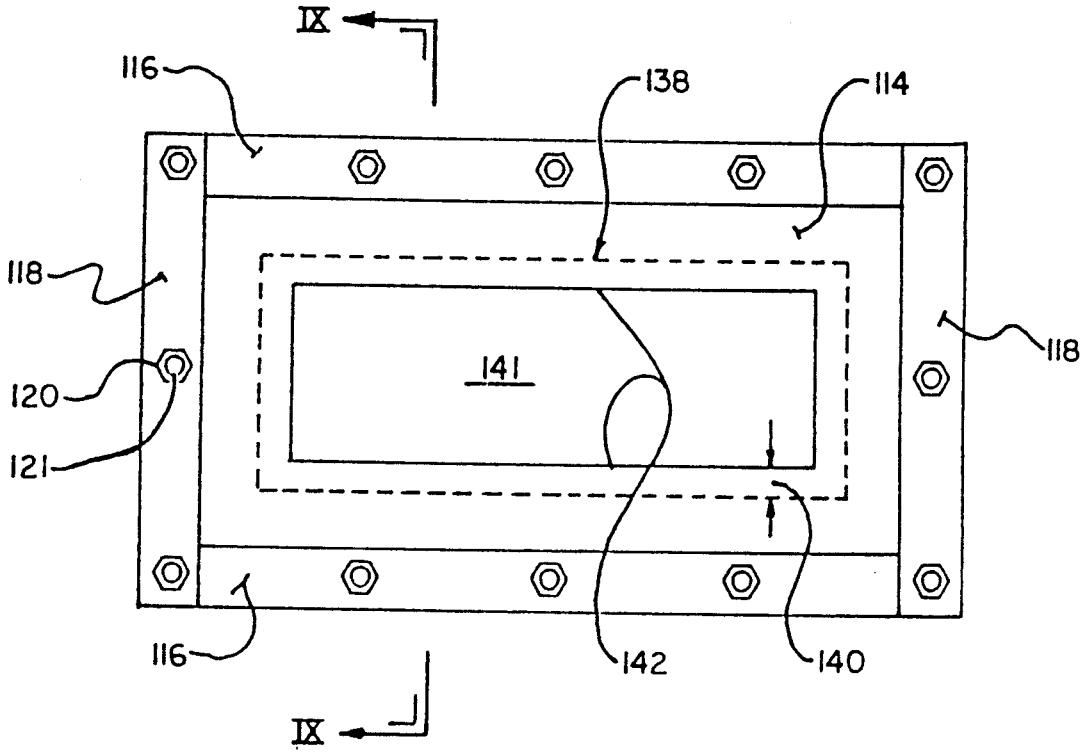
Figure 9:
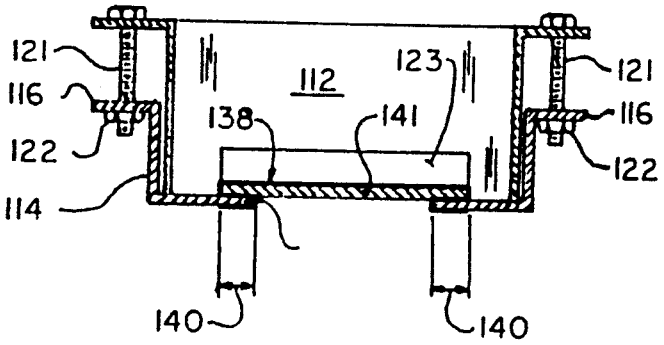
FIG. 9 is an inverted view of the sectional view taken along line IX—IX of FIG. 8.
Figure 10:
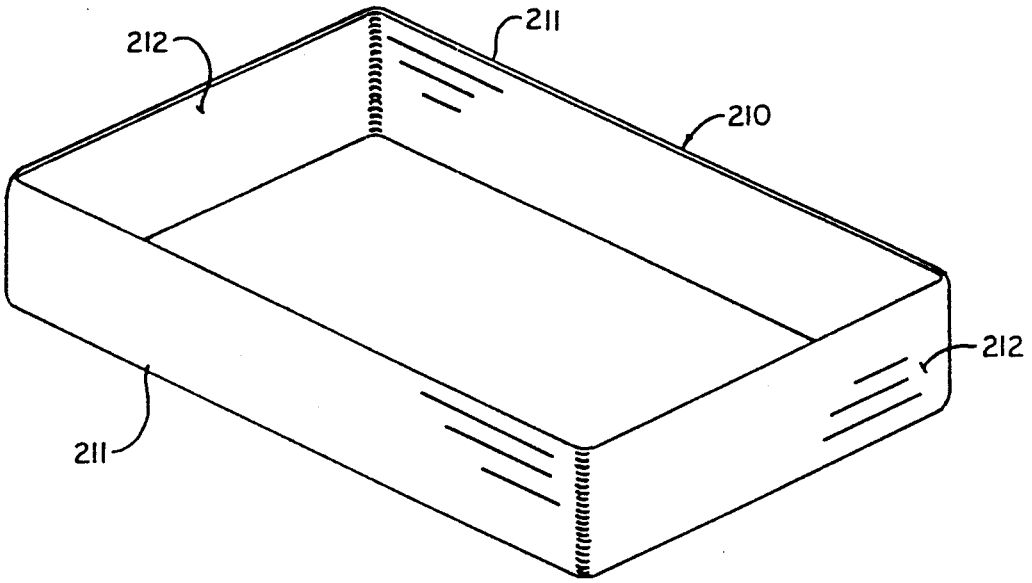
FIG. 10 through FIG. 14 are perspective view of a further embodiment the stencil screen apparatus of the present invention illustrating the sequence of construction thereof.

A more particular advantage manifested by the stencil screen assembly of the present invention illustrated in FIGS. 8 and 9 is that the portions of the support screen 114 extending laterally and longitudinally innermost in frame 110, i.e., those areas of the support screen underlying stencil screen 138 in bond area 140, form cantilever-like support surfaces or shoulders for supporting the overlapping edges of the stencil screen, thereby preventing the stencil screen from separating from the support screen after exposure of the stencil screen to prolonged and continually repeated applications of vertical force by a squeegee or the like in the direction of the substrate being printed.

Subsequent to complete bonding of the peripheral portions of the stencil screen to the support screen 114 along bond area 140, the next step in the preferred method of manufacture of the stencil apparatus of the present invention involves carefully removing a central portion of the support screen 114. This procedure is probably best appreciated with reference to FIG. 8, which is an inverted view of the screen assembly shown in FIG. 7 in a later stage of construction thereof. The removal of the central portion of the support screen is preferably performed by using a heated cutting device to create a window 142 in the support screen in order to expose the central portion 141 of the stencil screen. Window 142 is preferably cut slightly smaller in the area than bond area 140 so as not to damage either the stencil screen 138 or the bond area. Also, it is not recommended that the cutting of window 142 be performed by a sharp edged knife, razor, or the like, since the usually very thin and delicate metallic stencil screen material may be easily damaged by such utensils.

The removal of a central portion of the support screen permits the aforementioned pre-stressing tensile force in the support screen to uniformly stretch stencil screen 138 fully taut in all directions, hence positively eliminating all sags and wrinkles in the central region thereof and assuring the application of a high quality printed image during operating of the apparatus.

In order to achieve a highly resilient composite stencil screen construction in accordance with the present invention as well as the novel beneficial effects associated therewith, it is most preferred that the initial pre-stressing force applied to the support screen be of sufficient magnitude such that upon removal of the central portion of the support screen to form window 142, a substantial degree of the pre-stressing force remains in the support screen in order to continue to impart the necessary resilience thereto to achieve the desired printing results.

If, however, sags or wrinkles are still present in the central portion 141 of the stencil screen, then the aforementioned variable tensioning means can be manipulated in order to remove all sags and wrinkles therefrom. Furthermore, at this stage, tension in the support screen 114, and thus in stencil screen 138, may be raised to a level even higher than the initial tension of support screen 114.

Although for purposes of clarity and simplicity of illustration no printing image is shown as being formed in stencil screen 138, it is to be understood that subsequent to final retensioning, the stencil screen is impregnated, as is conventional, with an emulsion or other non-porous substance to leave a residual film within the screen, specifically within the central region 141 thereof. As with such practice, absence of the film will expose the screen for permitting passage of a suitable printing medium. In such condition, the screen assembly is ready for use.

Turning now to FIGS. 10-14 wherein like references indicate similar elements, there is seen a sequential depiction of a further method for constructing the stencil screen apparatus of the present invention. Similar to the prior art stencil screen apparatus shown in FIGS. 1-3 and that of the preferred embodiment, the stencil screen apparatus of this embodiment includes a frame 210 having opposed side walls 211 and opposed end walls 212.

Figure 11:
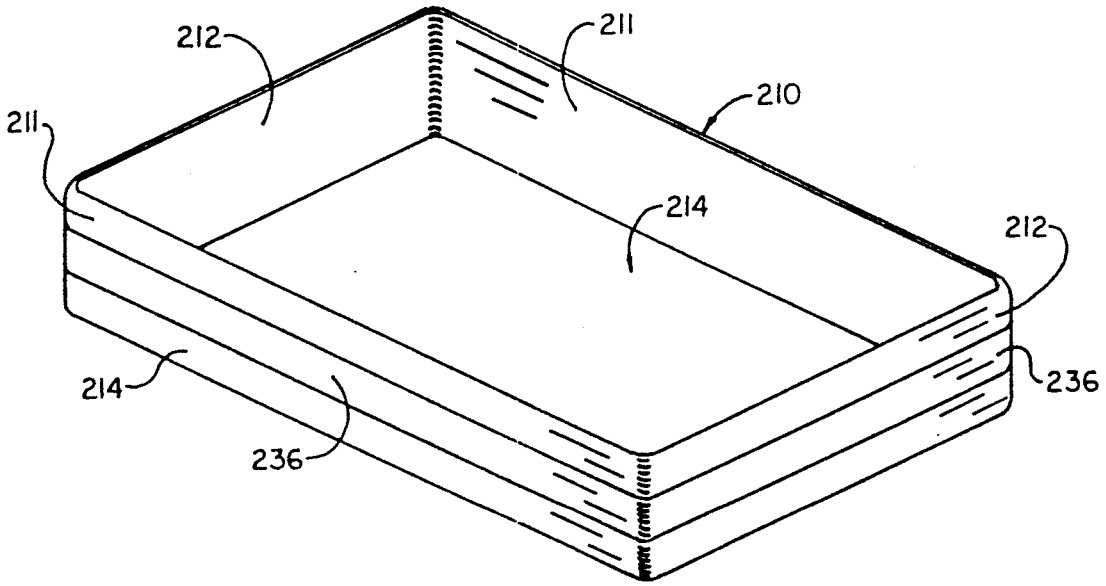

As in the first embodiment of the invention described hereinabove, FIG. 11 shows that a support screen 214 formed of a layer of material having relatively high suppleness and resilience, such as polyester mesh or the like is stretched along its longitudinal sides and its ends and is attached to frame 210. In this particular embodiment, however, the support screen is attached by adhesives or heat bonding, for example, to the outer sides of side walls 211 and end walls 212 along perimetrical bond area 236. Again, as with the preferred embodiment, during attachment to the side walls 211 and end walls 212 of frame 210, the side edges and end edges of screen 214 are held in tension at a uniform magnitude of tensile force, in this instance in an air stretcher or the like (not illustrated), whereby the support screen is uniformly prestressed in both its longitudinal and lateral dimensions so as to be assuredly taut, wrinkle free and in tight conformation with the shape of the frame 210. As in the preferred embodiment, upon attachment to frame 210, the screen 214 is imparted with a high degree of resilience in its unsupported central region, i.e., the region located interiorly of the boundary framed by side walls 211 and end walls 212.

Figure 12:
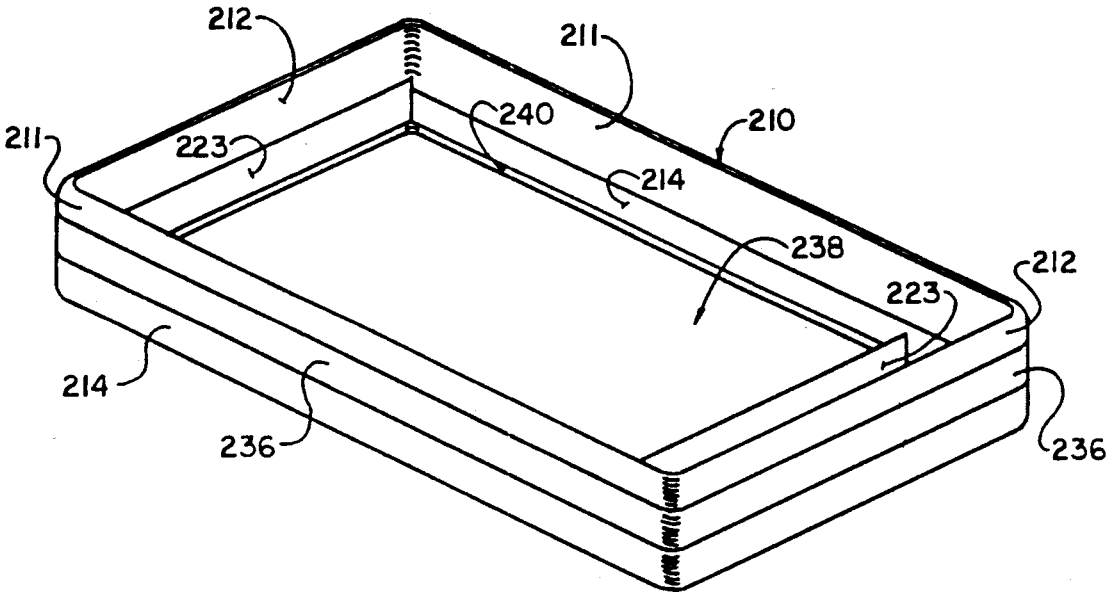

As FIG. 12 illustrates, in this embodiment, subsequent to attachment of the support screen 214 to frame 210, a metallic, preferably stainless steel, wire mesh stencil screen 238 of lesser width than the support screen 214 is laid flat and held in position, again, for example, by double-sided adhesive tape, on the side of the prestressed support 214 which is contacted by the printing material spreader during printing. The wire mesh stencil screen 238 is then permanently attached to the support screen as by adhesives or heat bonding, for example, along peripheral portions of a central region 241 thereof as indicated by area 240. Once again, the bond area 240, like bond area 140 of the preferred embodiment, must be sufficient to withstand shear forces exerted thereon during subsequent removal of a central portion of the support screen 214. When thermally responsive printing medium is used, metallic clamps 223, like clamps 23 and 123 discussed hereinabove, act as bus bars for producing resistance heating of stencil screen 238. Like the preferred embodiment, due to the electrical insulating capacity of the polyester mesh support screen 214, which is interposed between stencil screen 238 and frame 210, the need for elements such as the molded rubber gaskets 13 and 15 (FIGS. 1-3) at the bottom and top edges of the screen is again eliminated.

Figure 13:
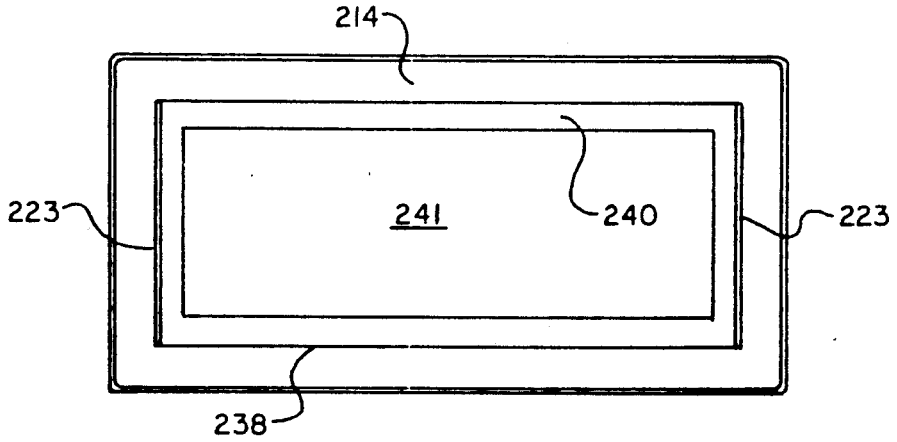
Figure 14:
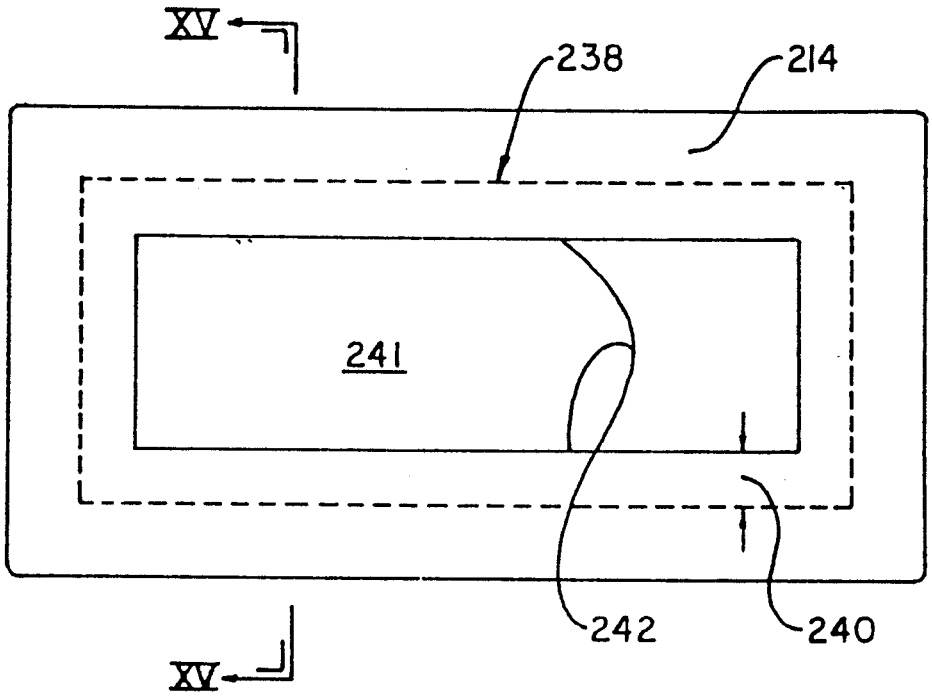

With specific reference to FIGS. 13 and 14, it is seen that subsequent to complete bonding of the peripheral portions of the central region 241 of the stencil screen to the support screen 214, the final step in this particular method of manufacture of the stencil apparatus of the present invention involves carefully removing a central portion of the support screen 214 by cutting with a heated cutting device to create a window 242 immediately behind the central region of the stencil screen. Window 242 is preferably cut slightly smaller in area than bond area 240 so as not to damage either the stencil screen 238 or the bond area 240.

Similar to the preferred embodiment, the removal of a central portion of the support screen permits the aforementioned pre-stressing tensile force in the support screen to uniformly stretch the central region 241 of stencil screen 238 fully taut in all directions, hence positively eliminating all sags and wrinkles in the central region thereof and assuring the application of a high quality printed image during operation of the apparatus.

Once again, no image for printing is shown as being formed in stencil screen 238. However, the stencil screen is impregnated with an emulsion or other nonporous substance to leave a residual film within the stencil screen, specifically within the central region 241 thereof subsequent to removal of the central portion of support screen 214. Again, absence of the film will expose the stencil screen for permitting passage therethrough of a suitable printing medium.

Similar to the preferred embodiment of the invention shown in FIGS. 8 and 9, the construction of FIGS. 14 and 15 once again reveals that the portions of the support screen extending laterally and longitudinally innermost within the opening in the frame form support surfaces or shoulders for supporting the overlapping edges of the stencil screen. Such an arrangement, as was previously mentioned, provides the advantage of preventing the stencil screen from separating from the support screen after prolonged and repeated applications of vertical force to the stencil screen by a squeegee of the like in the direction of the substrate being printed.

Figure 15:
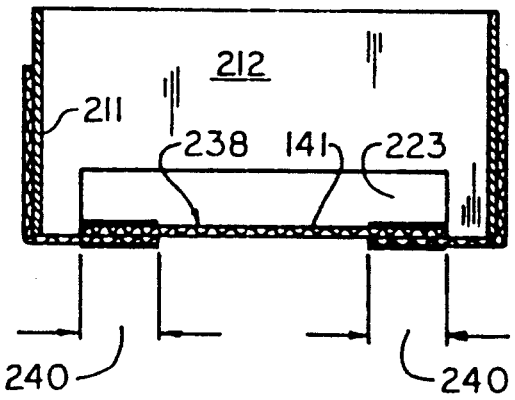
FIG. 15 is an inverted view of the sectional view taken along line XV—XV of FIG. 14.

The embodiment of the invention represented by FIGS. 14 and 15, although functional, is not preferred since the assembly is incapable of being retensioned subsequent to removal of the central portion of the support screen 214.

As an alternative to the methods of manufacture of the novel composite screen assembly of the present invention discussed above, it is also conceivable that a window or hole may first be cut in a resilient support screen of electrically insulating material, then a metallic stencil screen may be overlappingly attached to the support screen such that its stencil image is in alignment with the window. The support screen may then be stretched at a uniform magnitude of force in all directions while being attached to a frame to thereby impart to the composite assembly the desirable characteristics of uniform tension and high resilience. As before, the stencil screen is most preferably situated opposite the side of the support screen which faces and contacts the substrate during printing.

With the novel composite screen construction of the present invention, several critical objectives are achieved and several problems associated with existing stencil screen apparatus are solved. A summary of some of the many advantages of the present invention are as follows:

1) The use of a resilient non-electrically conductive support screen simplifies the construction of the stencil screen apparatus by eliminating many of the specially molded insulation elements previously required to electrically insulate metallic wire mesh stencil screens from their associated support frames;

2) In instances where the metallic stencil screen is heated by electrical resistance heating for the purpose of applying a thermally responsive printing medium, by reducing the width of metallic screen, i.e., by not extending the metallic screen upwardly along the side walls 11, the heating is more accurately controllable and uniform since the electrical energy is conducted along a narrower screen width than was heretofore possible, thereby eliminating peripheral heat losses from the side walls of the apparatus;

3) The reduced width and, therefore, the reduced area of the metallic stencil screens afforded by the composite constructions of the stencil screen apparatus of the present invention permits the resiliently supported stencil screen, for optimum design transference integrity, to be effectively laid at relatively low cost on a bias, i.e., wherein both the warp and weft strands of the stencil screen are not parallel to either the side walls or the end walls of the support frame, in stencil screen apparatus for printing flat article surfaces and in stencil screen apparatus for printing curved article surfaces. Heretofore, in stencil screen apparatus wherein the metallic stencil screen covered the entire opening of the screen frame, such a biased orientation of the stencil screen, although advantageous from the standpoint of producing a high quality printing image, was generally quite impractical in terms of both cost and construction due to the large amounts of wire mesh which were required to form the stencil screen and the difficulties in ensuring uniform tensioning of such a diagonally oriented screen, particularly in large-sized screen constructions;

4) Only the supple and resilient support screen contacts the edges of the stencil screen support frame; consequently, the damaging effects of fatigue on the metallic stencil screen are materially reduced and the service life of the screen is thereby substantially prolonged;

5) The pre-stressing force in the resilient support screen applies uniform tension in all directions to the image-bearing region of the metallic stencil screen such that the stencil screen exhibits a tight, wrinkle-free, high-quality printing surface;

6) The present construction permits hot or cold printing on flat or curved objects (cylinders, cones, ovals, etc.) and, in particular, rapid and effective printing in one or more colors using thermally responsive thermoplastic printing medium on flat substrates; and 7) In thermally dependent printing applications, the high inherent resiliency of the pre-stressed support screen serves to positively and instantaneously retract/lift the stencil screen from contact with the article surface being printed immediately after passage of the squeegee or similar applicator in order to prevent the screen from adhering to the relatively cooler article surface which rapidly cools and begins to set the heated thermally-responsive printing medium applied by the stencil screen printing apparatus.

Figure 16:
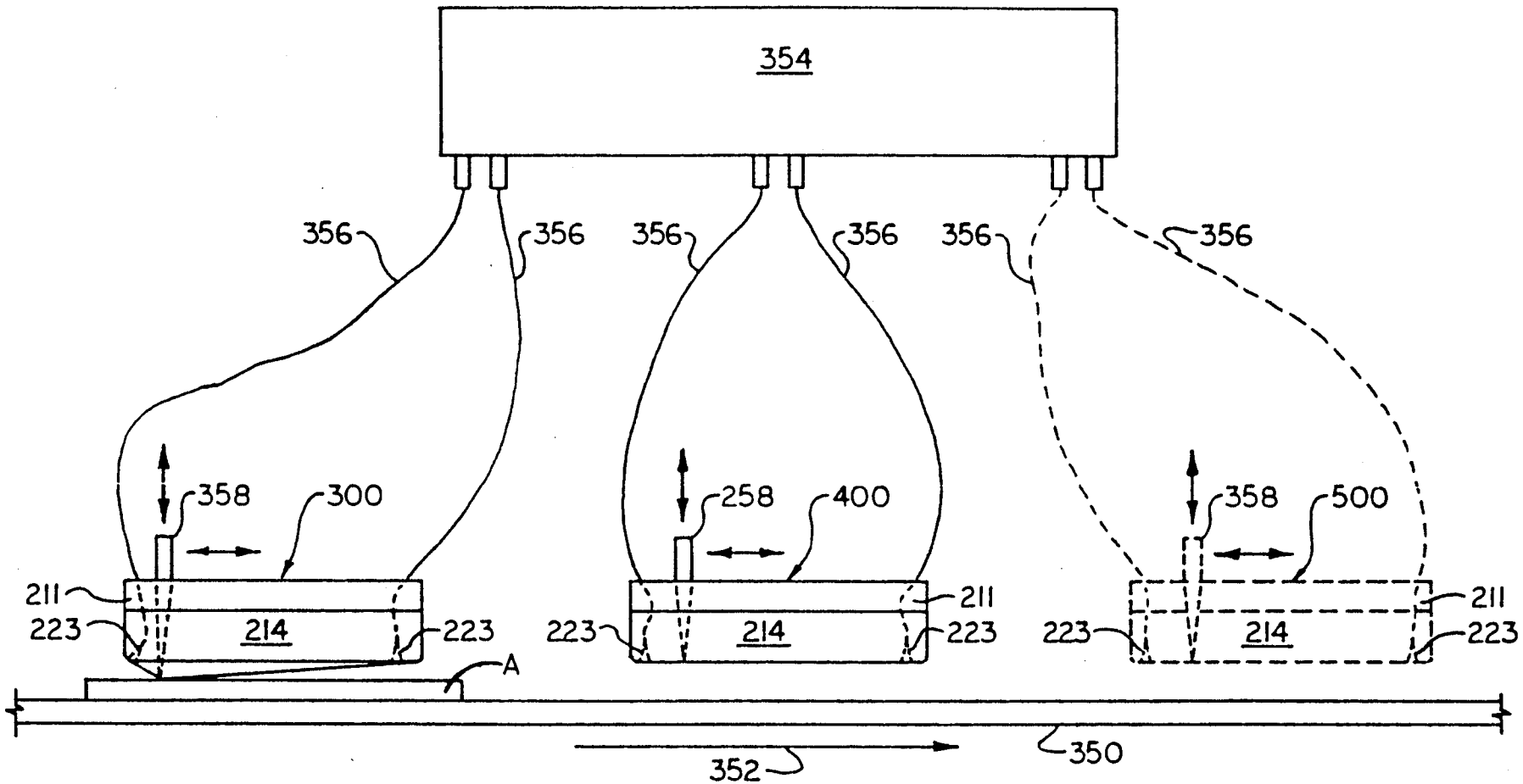
FIG. 16 is a schematic representation of the preferred method of use of the stencil screen apparatus of the present invention.

Advantage number (7) enumerated immediately hereabove is perhaps best appreciated with reference to the schematic representation of the preferred method of use of the stencil screen apparatus of the present invention depicted in FIG. 16. Illustrated therein in solid line are first and second stencil screen apparatus 300 and 400 and in dashed line a third stencil screen apparatus 500 each constructed in accordance with the second, i.e. non-preferred, embodiment of the present invention shown FIGS. 13 and 14 since it is of simpler construction and more suited for clearly representing the electrical system for heating the stencil screen by electrical resistance. An article "A" to be printed by stencil screen apparatus 300,400 and/or 500 is transported in increments by a powered conveyor means 350 in the direction of arrow 352. While at least one such stencil screen apparatus, e.g. stencil screen apparatus 300, can be successfully used to perform rapid and effective single-color printing of the surface of any number of articles a using thermoplastic printing medium, the preferred and most beneficial application of the present invention is when two or more such apparatus, e.g., stencil screen apparatus 300 and 400, are constructed and arranged in a series of printing stations to perform rapid multi-color printing of the upper surface of any number of articles using thermoplastic printing media.

Stencil screen apparatus 500 is depicted in dashed line since it may or may not be required for a multicolored printing process. Furthermore, depending upon the number of colors needed to complete a particular printing application, it is possible that more than three of the presently disclosed stencil screen apparatus may be used for performing the preferred printing method of the instant invention. Like stencil screen apparatus 300 and 400, stencil screen apparatus 500 (and any such additional stencil screen apparatus) may apply any chosen design and any desired color of thermoplastic medium to the surface of article A. Moreover, at the conclusion of the final thermoplastic printing operation, a layer of non-thermally-responsive printing medium may be applied to article A by a similarly constructed yet unheated stencil screen apparatus.

Each of the stencil screen apparatus 300, 400, 500, etc., is connected to a source of electrical energy 354 via suitable conductors 356 for permitting the application of electrical potential to the stencil screens 238, thereby causing electrical resistance heating thereof. Because the softening (application) temperatures of thermoplastic or thermally responsive printing media generally range from about 120° F. to about 200° F., it is preferred that the electrical energy supplied from source 354 be individually controllable for each stencil screen apparatus 300, 400, 500, etc., since it is possible that the softening temperature of the thermoplastic printing medium applied by one stencil screen apparatus may differ from that of the next. It is also conceivable that the other means, e.g., radiant heating means immersed in the thermally-responsive printing media, may be used to heat the printing media and the stencil screen in place of electrical resistance heating of the screen, if such is desired or necessary.

The general operation for multicolored printing of an article surface using thermoplastic printing media in accordance with the preferred embodiment of the present invention is as follows. An article A to be printed is transported by conveyor means 350 in the direction of arrow 352 to a position immediately beneath stencil screen apparatus 300 whereupon conveyor 350 is stopped. The heated and softened thermoplastic printing medium carried in stencil screen apparatus 300 is then caused to be spread onto the upper surface of article A. Specifically, a spreading means such as squeegee 358 is lowered by suitable means in order to stretch support screen 214 downwardly until the heated stencil screen 238 contacts the upper surface of the article A whereupon suitable translation means translate squeegee 358 (from left to right in FIG. 15) across the rear surface of the central region 241 of the stencil screen in order to spread the thermoplastic printing medium onto the upper surface of article A in the pattern or design formed on central region 241. Upon the completion of its translation across the rear surface of the stencil screen, the squeegee 358 is then raised upwardly and translated back to its initial ready position whereat it is reset to apply thermoplastic medium to the next article A which is transported to a position beneath stencil screen apparatus 300 by conveyor means 350. The conveyor means 350 then conveys article A to a position under stencil screen apparatus 400 and stops, and the above-described squeegee sequence is repeated. The article A is then transported to stencil screen apparatus 500, etc., and the cycle continues until printing is completed.

As noted hereinabove, the high inherent resiliency of the pre-stressed stencil screen 214 provides a return force which serves to positively and instantaneously retract or lift the stencil screen 238 from contact with the article surface being printed immediately after passage of the squeegee, thereby preventing the screen from adhering to the relatively cooler article surface which rapidly cools and begins to set the heated thermally-responsive printing medium. Because the thermoplastic material quickly becomes quite tacky as it begins to set, if the non-resilient metallic printing screens of the prior art were attempted to be used according to the present method, they would quickly begin to bond with the applied medium, thus damaging the printed image when the article was transported from a position beneath one stencil screen to the next.

In the prior art, if one were to use non-thermoplastic printing medium in a stencil screening operation of multicolored design, it was required that a flat article surface be printed with a first non-thermoplastic printing medium color and then permitted to cure to a non-tacky condition before the next color could be applied. Such was a time-consuming and inefficient process made obsolete by the present invention which enables the stencil screen to be instantly retracted from the printed surface after passage of the squeegee, hence permitting rapid and continuous printing of multicolored images on flat article surfaces in a high-volume production environment.

Although illustrated as printing a flat surface, the stencil screen apparatus 300, 400, 500, etc. of the present invention may, according to the preferred method of use disclosed herein, also be used to print substantially flat planar surfaces where only a part of the screen displaced by the squeegee contacts the planar surface and the only contact maintained between the screen and the planar surface is caused by movement of the squeegee along the plane that is substantially parallel to the plane of the screen, undeflected, which is also substantially parallel with the planar surface of the workpiece.

The planar relation between the plane of the screen, the plane of movement by the squeegee and the plane of movement of the workpiece achieves the improved printing operation of the present invention by allowing the volume of a liquid ink passed through the opening passes in the screen to immediately freeze upon separation of those open spaces from the planar substrate. The immediate freezing of the printing medium greatly enhances the use of the present invention for multi-color printing since sequential color printing can be carried out without carrying delay between each of the printing operations. This is greatly advantageous in color on color printing where, for example, a first printing of a color forms a base to receive in a superimposed relation additional color by subsequent printing operations.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

We claim:

1. A method for printing indicia on a substrate, said method comprising the steps of:

(a) selecting a substrate defining a substantially planar surface for the reception of printed indicia thereon;

(b) selecting a stencil screen apparatus including:

a frame having walls defining an opening in said frame;

a stencil screen; and resilient material attached to said frame and said stencil screen for resiliently supporting and substantially uniformly tensioning said stencil screen in all directions within the plane of said stencil screen, said resilient material having a first surface to which said stencil screen is adhesively attached and a second surface facing opposite said first surface, said second surface facing said substrate during printing thereof by said assembly;

(c) elastically stressing said resilient material to create a resilient screen restoring force by using a printing applicator to move a portion of said stencil screen which is in contact with a printing applicator in a direction to bring a displaced part of the screen into contact with said planar surface of the substrate, said stencil screen being moved in a direction against said resilient material to minimize stressing of the adhesive attachment therebetween;

(d) urging a printing medium to pass through exposed spaces in the stencil screen by the passage of said applicator along a plane generally parallel with said plane of the stencil screen for transferring the printing medium onto said substrate; and (e) using the said restoring force of the elastically stressed resilient material to positively and instantaneously retract said stencil screen from said indicia receiving surface of the substrate upon passage of said applicator.

2. A method for printing indicia upon a substrate using a thermally responsive printing medium, said method comprising the steps of:

(a) selecting a substrate defining a substantially planar surface for the reception of printed indicia thereon;

(b) selecting a stencil screen apparatus including:

a frame having walls defining an opening in said frame;

a stencil screen;

resilient material attached to said frame and said stencil screen for resiliently supporting and substantially uniformly tensioning said stencil screen in all directions within the plane of said stencil screen, said resilient material having a first surface to which said stencil screen is adhesively attached and a second surface facing opposite said first surface, said second surface facing said substrate during printing thereof by said assembly; and means connected to said stencil screen for conducting an electric current through said stencil screen in order to cause electrical resistance heating of said stencil screen, said electrical resistance heating causing softening of thermally responsive printing medium contained in said stencil screen apparatus and permitting application of said thermally responsive printing medium onto said article surface;

(c) conducting electric current through said means for conducting in order to heat said stencil screen and soften said thermally responsive material contained therein;

(d) urging a printing medium to pass through exposed spaces in the stencil screen by the passage of said applicator along a plane generally parallel with said plane of the stencil screen for transferring the printing medium onto said substrate;

(e) allowing the transferred printing medium to freeze on said substrate and concurrently therewith; and (f) using the said restoring force of the elastically stressed resilient material to positively and instantaneously retract said stencil screen from said indicia receiving surface of the substrate upon passage of said applicator.

3. A method for printing a multicolored design upon a substrate using thermally responsive printing media in a plurality of colors, said method comprising the steps of:

(a) selecting a substrate defining a substantially planar surface for the reception of printed indicia thereon;

(b) selecting a plurality of stencil screen apparatus, each of said plurality of stencil screen apparatus including;

a frame having walls defining an opening in said frame;

a stencil screen;

resilient material attached for resiliently supporting said frame and said stencil screen for supporting and substantially uniformly tensioning said stencil screen in all directions within the plane of said stencil screen, said resilient material having a first surface to which said stencil screen is adhesively attached and a second surface facing opposite said first surface, said second surface facing said substrate during printing thereof by said assembly; and means connected to said stencil screen for conducting an electric current through said stencil screen in order to cause electrical resistance heating of said stencil screen, said electrical resistance heating causing softening of thermally responsive printing medium contained in said stencil screen apparatus and permitting application of said thermally responsive printing medium onto said substrate, each of said stencil screen apparatus containing a thermally responsive printing medium of predetermined color;

(c) arranging said plurality of stencil screen apparatus into a series of printing stations;

(d) conducting electric current through said means for conducting of each of said plurality of stencil screen apparatus in order to heat the stencil screen thereof and soften said thermally responsive material contained therein; and (e) printing said substrate sequentially by each of said plurality of stencil screen apparatus in said series of printing stations, wherein at each of said printing stations the printing operation comprises:

(f) elastically stressing said resilient material to create a resilient screen restoring force by using a printing applicator to move a portion of said stencil screen which is in contact with a printing applicator in a direction to bring a displaced part of the screen into contact with said planar surface of the substrate, said stencil screen being moved in a direction against said resilient material to minimize stressing of the adhesive attachment therebetween;

(g) urging a printing medium to pass through exposed spaces in the stencil screen by the passage of said applicator along a plane generally parallel with said plane of the stencil screen for transferring the printing medium onto said substrate; and (h) using the said restoring force of the elastically stressed resilient material to positively and instantaneously retract said stencil screen from said indicia receiving surface of the substrate upon passage of said applicator.

4. The method of claim 3 further comprising the step of sequentially transporting said substrate to each of said plurality of printing stations to allow printing of said substrate thereat.

5. The method of claim 4 wherein the step of sequentially transporting said substrate further comprises discontinuously transporting said substrate to each of said plurality of printing stations.

* * * * *